US006415786B1

(12) United States Patent
Kolbe et al.

(10) Patent No.: US 6,415,786 B1
(45) Date of Patent: Jul. 9, 2002

(54) CONTAINER FOR A RESPIRATOR

(75) Inventors: Ernst-Günther Kolbe, Mölln; Rainer Grendel, Krummesse; Rüdiger Müller; Werner Jumpertz, both of Stockelsdorf, all of (DE)

(73) Assignee: Dräger Sicherheitstechnik GmbH (DE)

( * ) Notice: Subject to any disclaimer, the term of this patent is extended or adjusted under 35 U.S.C. 154(b) by 0 days.

(21) Appl. No.: 09/573,722

(22) Filed: May 18, 2000

(30) Foreign Application Priority Data

Sep. 8, 1999 (DE) ..... 199 42 850

(51) Int. Cl.[7] ..... B65D 45/00
(52) U.S. Cl. ..... 128/200.24; 220/318
(58) Field of Search ..... 128/200.24, 204.27, 128/205.22, 205.15, 204.18, 203.12; 220/324, 318, 322, 480, 481, 756; 292/11; 25/30; 56/DIG. 11; 785/306

(56) References Cited

U.S. PATENT DOCUMENTS 2,879,916 A * 3/1959 Hoffmann et al. ..... 220/322
3,747,796 A * 7/1973 Kneier ..... 220/29
3,817,419 A * 6/1974 Moller et al. ..... 220/59
4,094,542 A * 6/1978 Siblik ..... 292/256.5
4,314,651 A * 2/1982 Gaiser et al. ..... 220/326
4,347,944 A * 9/1982 Moldrup ..... 220/320
4,351,448 A * 9/1982 Ingersoll et al. ..... 206/508
4,915,913 A * 4/1990 Williams et al. ..... 422/119
4,917,261 A * 4/1990 Borst ..... 220/324
5,103,994 A * 4/1992 Doxey et al. ..... 220/318
5,160,060 A * 11/1992 Garofalo, Jr. ..... 220/318
5,226,553 A * 7/1993 Fiore ..... 206/315.11
5,755,222 A * 5/1998 Pansard et al. ..... 128/204.27
5,769,258 A * 6/1998 Harrison et al. ..... 220/203.1
5,918,762 A * 7/1999 Gaba et al. ..... 206/1.5
5,971,218 A * 10/1999 Le ..... 222/185.1

* cited by examiner

*Primary Examiner*—John G. Weiss
*Assistant Examiner*—Mital Patel
(74) *Attorney, Agent, or Firm*—McGlew and Tuttle, P.C.

(57) ABSTRACT

A container for the gastight sealing of a respirator. The container has two container shells (1, 2) abutting on front surfaces with a circumferential sealing element. The container second container shell (2) is provided with a handle (3) mounted at two opposite points of rotation (6). The handle (3) has a lever arm (5), which engages in the first container shell (1) in the closed position of the container. In the closed position of the container, the handle (3) preferably engages in an additional bracket (4) that is detachably connected to the first container shell (1).

14 Claims, 2 Drawing Sheets

CONTAINER FOR A RESPIRATOR

FIELD OF THE INVENTION

The present invention pertains to a container for the gastight sealing of a respiratory with two container shells which abut on front surfaces with a circumferential sealing element.

BACKGROUND OF THE INVENTION

Such a container is disclosed in DE 42 39 766 C2 and has a sealing means for the gastight sealing of the container. The prior-art container comprises two container shells abutting on front surfaces, and the front surfaces are provided on their circumferences with a groove, into which a sealing element is inserted. Although the prior-art container is satisfactory in terms of the sealing function, there is a desire to provide a further improvement in the sealing function and in the mechanical handling.

SUMMARY AND OBJECTS OF THE INVENTION

The primary object of the present invention is to improve the prior-art container with a sealing means, such that the sealing function is guaranteed even under high mechanical load, whereby, however, on the other hand, the container can be opened with very few movements even with the presence of a pressure difference between the container interior and the environment.

According to the invention, a container for the gastight sealing of a respirator is provided with two container shells which abut on front surfaces with a circumferential sealing element. The second container shell is provided with a handle that is mounted at two opposite points of rotation. The handle has a lever arm, which engages in the first container shell in a closed position of the container.

The handle preferably has a lever arm, which engages in an additional bracket in the closed position of the container. The bracket is detachably connected with the first container shell. The bracket preferably has bent, lateral stops, which are supported on an edge of the first container shell and bring about a locking of the container in the direction of the lateral axis of the container.

The handle may have a cam disk and the first container shell may have a sliding pulley, such that, to open the container by means of the rotary movement of the said handle, the cam disk is supported on the sliding pulley, and the two container shells are pressed apart. The stroke of the cam disk is preferably selected such that a circumferential sealing element in grooves in the front surfaces of the abutting container shells is lifted out of the groove of the container shells when the container is opened.

At the upper area turned away from the points of rotation, the handle may be provided with a stop and a spring-mounted metal tab, which are supported on the edges of the container shells in the closed position of the container. The metal tab may be designed as a fret for spring-mounting on the container, so that the metal tab is lifted over the edges of the container shells on the basis of the elasticity of the handle.

A rear of the first container shell may be provided with the pins, which engage in the transversely arranged grooves of the bracket, so that the container, in the closed position, is locked in relation to the vertical axis of the container. The bracket has the spring-mounted metal tabs, which engage in the first container shell. An elastic element is preferably arranged between the bracket and the first container shell and is actuated by means of the handle, so that the elastic element presses against the first container shell after the container is unlocked, lifts the pins out of the grooves of the bracket and releases the container for removal.

The container shells are preferably made of plastic and the handle is preferably made of steel.

An essential advantage of the present invention, compared to the state of the art, is that, for opening the container with a relatively low expenditure of force, the rotary movement of the handle with the cam disk being supported on a sliding pulley of the lower container shell leads to a reliable pressing apart of the two container shells.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
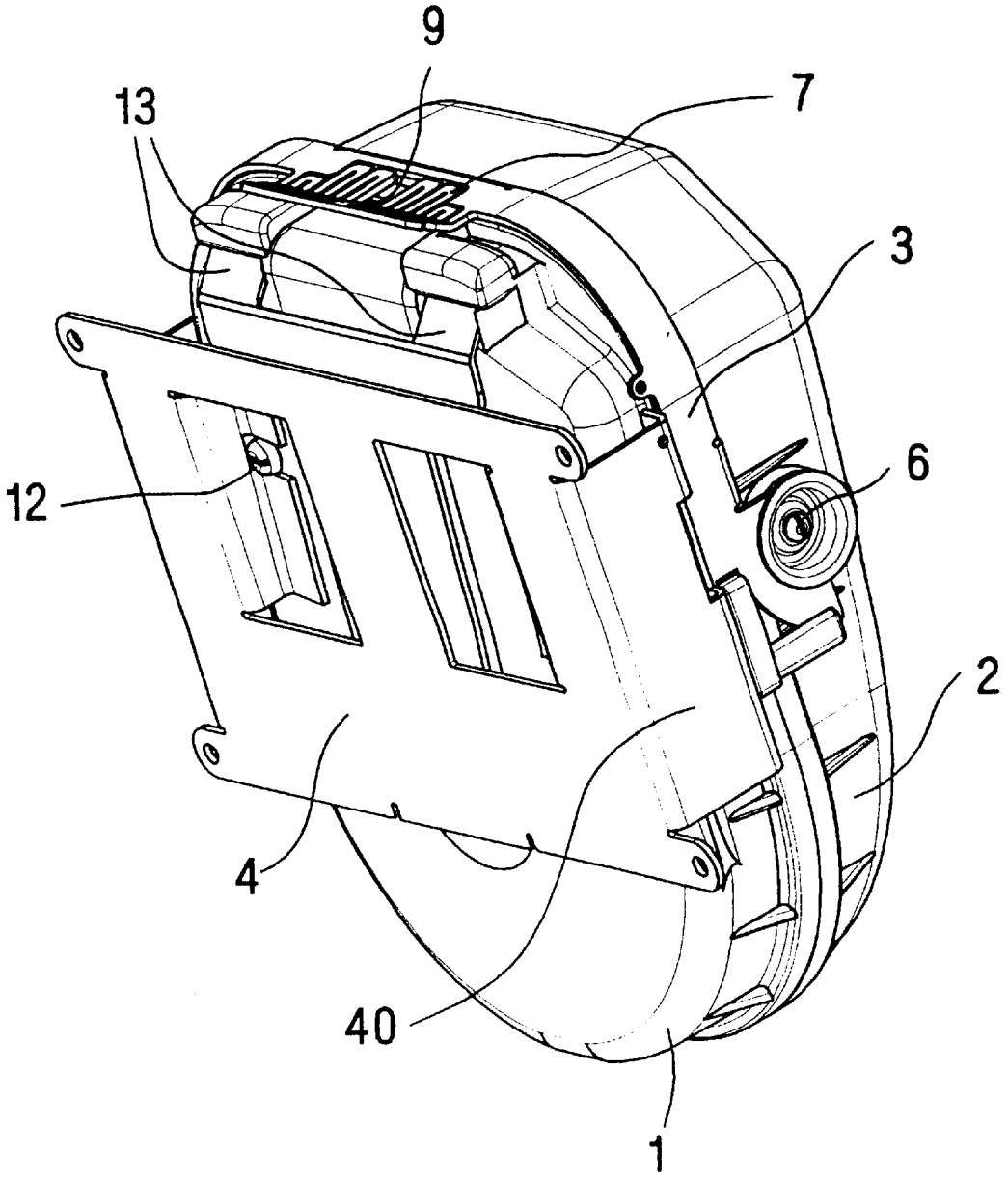
FIG. 1 is a perspective view of a container for a respirator in the closed position.

Referring to the drawings in particular, as can be seen in FIG. 1, the container for a respirator comprises two container shells 1, 2, which are especially made of metal or plastic. The two container shells 1, 2 have front surfaces that abut. These front surfaces are provided on their circumferences with a groove into which a sealing element is inserted (not shown). Containers of this type are especially used for the gastight sealing of a respirator with moisture-sensitive chemical compound, e.g., in the area of underground mining, where in case of an emergency, corresponding respirators must quickly be available, to make possible a safe breathing of humans even in a toxic environment. The availability must be provided even in the presence of a differential pressure between the environment and the interior of the container.

Figure 2:
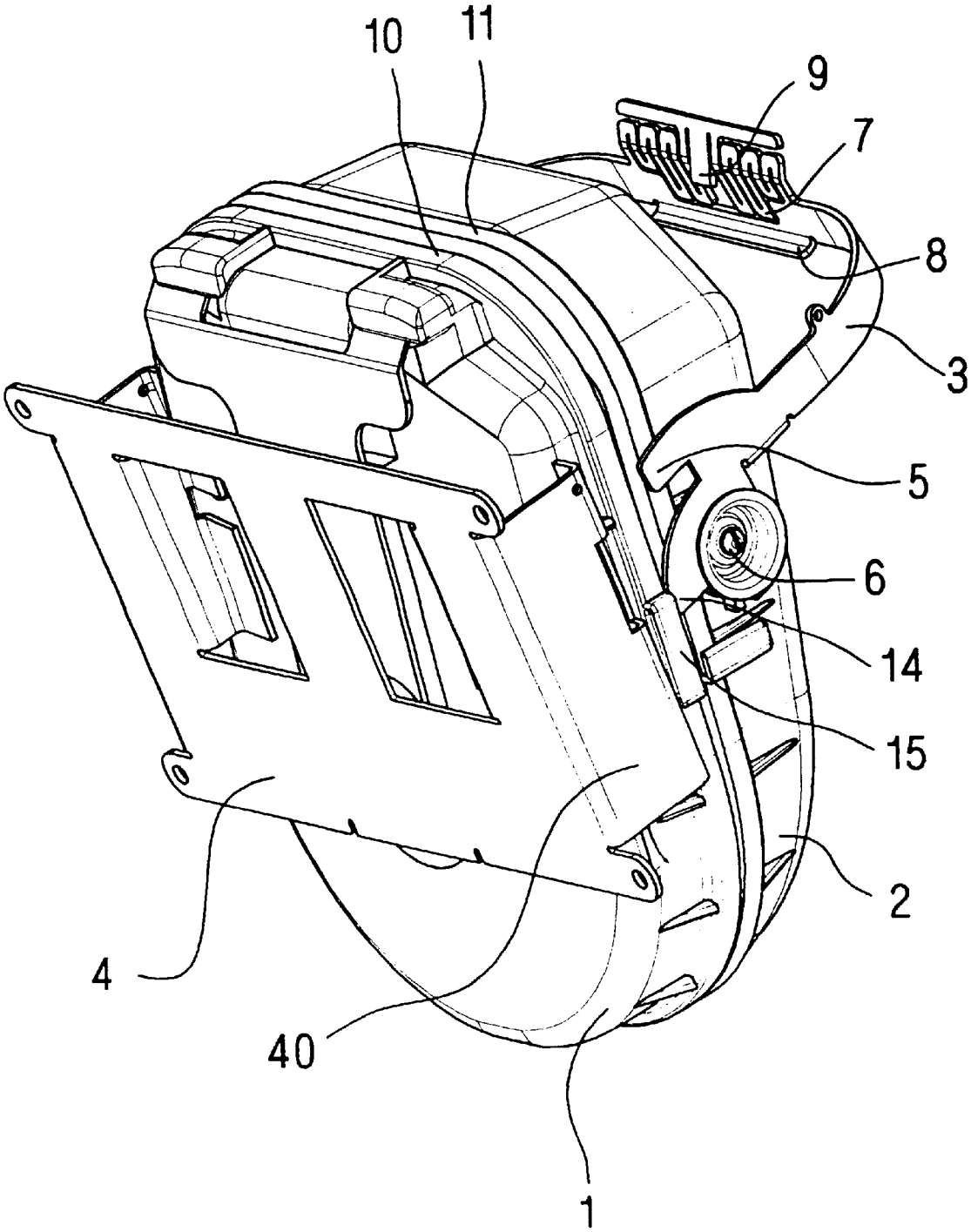
FIG. 2 is a perspective view of a container for a respirator in the position of opening.

The essence of the present invention is that the right (as shown in FIGS. 1 and 2), outer, second container shell 2 in the present exemplary embodiment is provided with a handle 3. The handle 3 is rotatably mounted at two opposite handle points 6 on the second container shell 2, and the first, left container shell 1 is preferably equipped with a detachable bracket 4 for the storage of the container, e.g., after fastening to a wall, which accommodate a lever arm 5. The lever arm 5 is part of the handle 3 (FIG. 2). With this construction, the two container shells 1, 2 are pressed together in the closed position. In addition, an elastic element 7 in the upper area of the handle 3 together with a stop 8 and a metal tab 9, which are supported against the projecting edges 10, 11 of the container shells 1, 2, provide for a reliable sealing of the containers shells 1, 2.

The lateral axis of the container is additionally locked by means of lateral stops 40 on the bracket 4. The vertical axis of the container is locked by means of pins 12 that are rigidly connected with the rear of the lower, first container shell 1, on the left in the figures, and engage in the transversely arranged grooves of the bracket 4. The container is also locked by means of metal tabs 13, which are connected in a spring-mounted manner with the bracket 4 and engage in the first container shell 1.

As shown in FIG. 2, to open the container the spring-mounted metal tab 9 of the handle 3 is pulled over the edges 10, 11 of the container. With a rotary movement of the handle 3, the locking of the lever arm 5 in the bracket 4 is released. By means of the rotary movement, the container shells 1, 2 are pressed apart by means of a cam disk 14 of the handle 3, which is supported on and presses against a slide pulley or slide surface 15 of the lower container shell 1.

While a specific embodiment of the invention has been shown and described in detail to illustrate the application of the principles of the invention, it will be understood that the invention may be embodied otherwise without departing from such principles.

What is claimed is:

1. A container for gastight sealing of a respirator, the container comprising:

a first container shell with a sealing surface and a sliding pulley;

a second container shell with a sealing surface, said first container shell sealing surface abutting said second container shell sealing surface with a circumferential sealing element in a closed position;

a handle provided with said second container shell, said handle being rotatably mounted to said second container shell at two opposite handle points, said handle including a cam disk such that, to open the container by means of rotary movement of said handle, said cam disk is supported on said sliding pulley whereby said container shells are pressed apart; and a lever arm connected to said handle for engaging said first container shell in a closed position of the container.

2. The container in accordance with claim 1, further comprising: a bracket detachably connected with said first container shell, said lever arm engaging in said bracket in the closed position of the container.

3. The container in accordance with claim 2, wherein said bracket has bent, lateral stops, which are supported on an edge of said first container shell, said stops being provided to bring about a locking of the container in a direction of a lateral axis of the container.

4. The container in accordance with claim 2, wherein a rear of said first container shell is provided with pins, which engage in transversely arranged grooves of said bracket, so that the container, in the closed position, is locked in relation to a vertical axis of the container.

5. The container in accordance with claim 4, wherein said bracket has spring-mounted metal tabs, which engage in said first container shell.

6. The container in accordance with claim 4, further comprising: pins and an elastic element arranged between said bracket and said first container shell and actuated by said handle, whereby said elastic element presses against said first container shell after the container is unlocked, lifts said pins out of grooves of said bracket and releases said container for removal.

7. The container in accordance with claim 1, wherein said cam disk has a stroke selected such that a circumferential sealing element in grooves in the front surfaces of said abutting container shells is lifted out of the groove of the container shells when the said container is opened.

8. The container in accordance with at claim 1, wherein, in an upper area turned away from said handle points, said handle has a stop and a spring-mounted metal tab, said metal tab being supported on edges of said container shells in the closed position of the container.

9. The container in accordance with claim 8, wherein said metal tab is a fret spring-mountable on the container, whereby said metal tab is lifted over the edges of said container shells on a basis of an elasticity of said handle.

10. The container in accordance with claim 1, wherein said container shells are made of plastic and said handle is made of steel.

11. A container for gastight sealing of a respirator, the container comprising:

a first container shell with a sealing surface;

a second container shell with a sealing surface, said first container shell sealing surface abutting said second container shell sealing surface with a circumferential sealing element in a closed position;

a handle provided with said second container shell, said handle being rotatably mounted to said second container shell at two opposite points;

a lever arm connected to said handle for engaging said first container shell in a closed position of the container;

a bracket detachably connected with said first container shell, said lever arm engaging in said bracket in the closed position of the container, said bracket defining transversely arranged grooves, a rear of said first container shell is provided with pins engageable in said transversely arranged grooves of said bracket to lock the container in a closed position relative to a vertical axis of the container.

12. The container in accordance with claim 11, wherein said bracket has spring-mounted metal tabs, which engage in said first container shell.

13. The container in accordance with claim 11, further comprising: pins and an elastic element arranged between said bracket and said first container shell and actuated by said handle, whereby said elastic element presses against said first container shell after the container is unlocked, lifts said pins out of grooves of said bracket and releases said container for removal.

14. A container for gastight sealing of a respirator, the container comprising:

a first container shell with a sealing surface and a sliding surface;

a second container shell with a sealing surface, said second container shell being positionable adjacent said first container shell to arrange said first container sealing surface opposite said second container shell sealing surface;

a handle rotatably mounted to said second container shell at two opposite handle points, said handle including a cam disk positionable against said sliding surface to press said container shells apart by rotary movement of said handle;

a lever arm connected to said handle and engageable with said first container shell in a closed position of the container.

* * * * *